US007372007B1

(12) United States Patent
McClanahan et al.

(10) Patent No.: US 7,372,007 B1
(45) Date of Patent: May 13, 2008

(54) MEDIUM VOLTAGE HEATER ELEMENT

(75) Inventors: Jack L. McClanahan, Montgomery, TX (US); Craig S. Tiras, Houston, TX (US); Jackie G. Fannin, Brookshire, TX (US)

(73) Assignee: Gaumer Company, Inc., Houston, TX (US)

( * ) Notice: Subject to any disclaimer, the term of this patent is extended or adjusted under 35 U.S.C. 154(b) by 0 days.

(21) Appl. No.: 11/742,892

(22) Filed: May 1, 2007

Related U.S. Application Data

(63) Continuation-in-part of application No. 11/357,703, filed on Feb. 17, 2006.

(60) Provisional application No. 60/796,400, filed on May 1, 2006, provisional application No. 60/653,763, filed on Feb. 17, 2005.

(51) Int. Cl.
*H05B 3/44* (2006.01)

(52) U.S. Cl. ..... 219/544; 219/618; 219/624; 219/628; 219/629; 219/630; 219/59.1; 219/67; 219/236; 219/243; 219/437; 219/523; 219/534; 219/535; 219/541; 219/542

(58) Field of Classification Search ..... 219/618, 219/624, 628–30, 59.1, 67, 236, 243, 437, 219/523, 534–5, 541–2, 544
See application file for complete search history.

(56) References Cited

U.S. PATENT DOCUMENTS 5,396,574 A * 3/1995 Base et al. ..... 392/489

* cited by examiner

*Primary Examiner*—Shawntina Fuqua
(74) *Attorney, Agent, or Firm*—Bracewell & Giuliani LLP

(57) ABSTRACT

An electrical heater bundle has heater elements, each including a metal tube, an electrical resistance coil within the tube, a conductor pin connected to the coil and protruding from an end of the tube, and an electrical insulation powder surrounding the coil within the tube. A conical cavity is located in the insulation powder at the end of the tube, the cavity extending from an inner diameter of the tube to the conductor pin. The cavity is filled with an epoxy that is cured in place. The insulation powder may have an infiltrated layer at the cavity that is an uncured liquid silicone. The heater elements are mounted to a header plate, and the elements associated with the three different phases of electrical power may protrude past the header plate at different distances.

13 Claims, 3 Drawing Sheets

Fig. 3
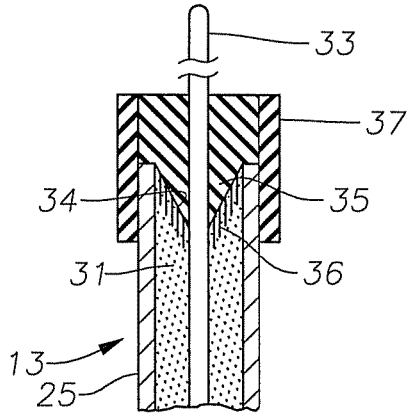
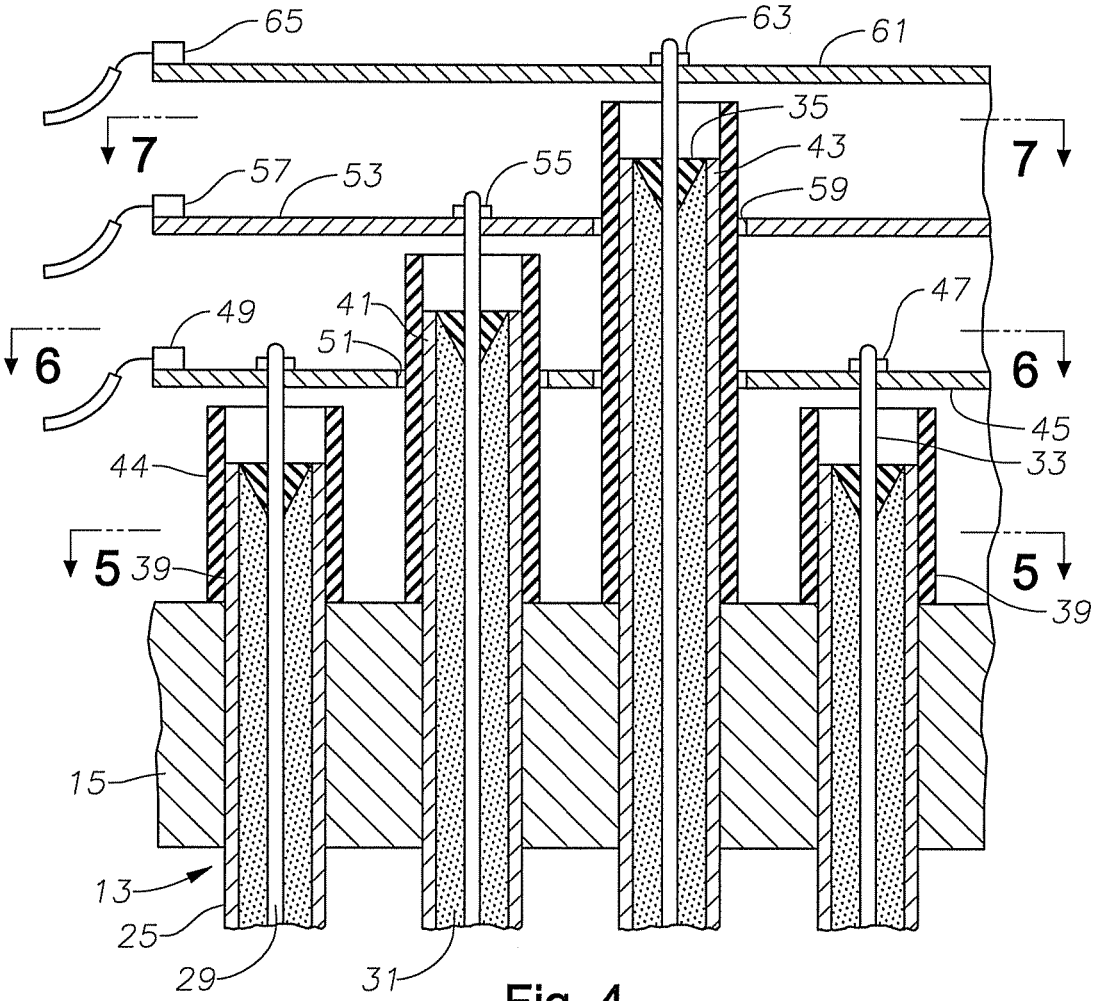
Fig. 4

MEDIUM VOLTAGE HEATER ELEMENT

CROSS-REFERENCE TO RELATED APPLICATIONS

This application claims priority to provisional application 60/796,400, filed May 1, 2006 and is a continuation-in-part from application Ser. No. 11/357,703, filed Feb. 17, 2006, which claimed priority to provisional application 60/653,763, filed Feb. 17, 2005.

FIELD OF THE INVENTION

This invention relates in general to heater elements for process heat exchangers, and in particular to heater elements that are constructed for voltages higher than normally utilized for process heat exchangers.

BACKGROUND OF THE INVENTION

One type of process heat exchanger used in various industries comprises a tank having an inlet and an outlet for the liquid to flow through. One or more heater element bundles are mounted in the tank. Each heater element bundle has a number of electrical resistance heater elements. Each heater element includes a metal tube, an electrical resistance coil within the tube and embedded in an insulation powder, and a conductor pin secured to the end of the coil. The heater element bundle has at least one end located outside of the tank, that end having a header to which each tube is secured. The opposite end may also include a header or the tubes may be U-shaped.

Voltage is applied to the conductor pins to create heat in the electrical resistance coils. Most process heat exchangers operate with three-phase power in the range from about 600 to 640 volts. More recently heat exchangers have been proposed to operate in the range from about 2,400 to 4,160 volts. Although considered a medium voltage for electrical power transmission in general, this voltage creates more demands on the heat exchanger heater elements.

The insulation powder is typically magnesium oxide packed tightly within the tube surrounding the coiled wire. While magnesium oxide provides excellent electrical insulation, it is a desiccant, thus it attracts moisture from the surrounding atmosphere. The penetration of moisture reduces the ability of the insulation powder to insulate.

In the past, heater elements of this nature have been kept in low humidity rooms and/or baked in an oven with their ends open to drive off any moisture. Then, when ready for use, the heater element is mounted to a header plate and seals are placed over the open ends. For example, a liquid sealant may be poured over the open ends and cured. While these methods work, improving the resistance of the insulation is desirable not only for low voltage process heat exchanger elements but particularly for medium voltage heater elements. The higher voltage is more difficult to insulate, particularly at the exposed end face of the insulation powder, which is subject to moisture penetration.

SUMMARY OF THE INVENTION

In this invention, the electrical heater elements have a cavity in the insulation powder at the end of the tube concentric with the conductor pin. An electrical insulation plug is located within and mates to the cavity. The insulation plug seals around the conductor pin, seals to the tube, and seals the insulation powder from exposure to atmosphere at the end of the tube. Preferably the plug is formed of epoxy that is poured into the cavity and cured in place.

Preferably the cavity and the plug are generally conical and has a maximum diameter equal to an inner diameter of the tube. Also, in the preferred embodiment, the insulation powder has a layer of uncured liquid silicone infiltrated therein at the cavity.

In one embodiment, some of the heater elements protrude past the header plate at different distances to reduce the proximity of connector pins of the different elements to each other. Preferably, those at the closest distance are connected to one phase of a three-phase power source by a first conductor plate. The first conductor plate has holes through which the second phase and third phase heater elements protrude. A second conductor plate is connected to ends of the conductor pins of the second phase elements and has holes through which the third phase heater elements protrude. A third conductor plate is connected to ends of the conductor pins of the third phase heater elements. The second conductor plate is located between the first and third conductor plates. An insulation sleeve encases each tube of each of the second phase heater element and extends from the header plate through one of the holes in the first conductor plate. An insulation sleeve encases each tube of each of the third phase heater elements and extends from the header plate through one of the holes in the second conductor plate.

BRIEF DESCRIPTION OF THE DRAWINGS

FIG. 3 is a sectional view of a portion of one the heater elements of FIG. 1, but showing a removable installation sleeve for use in installing an epoxy plug.

FIG. 4 is a schematic partial sectional view of some of the heater elements of FIG. 1 installed within a header plate.

DETAILED DESCRIPTION OF THE INVENTION

Figure 1:
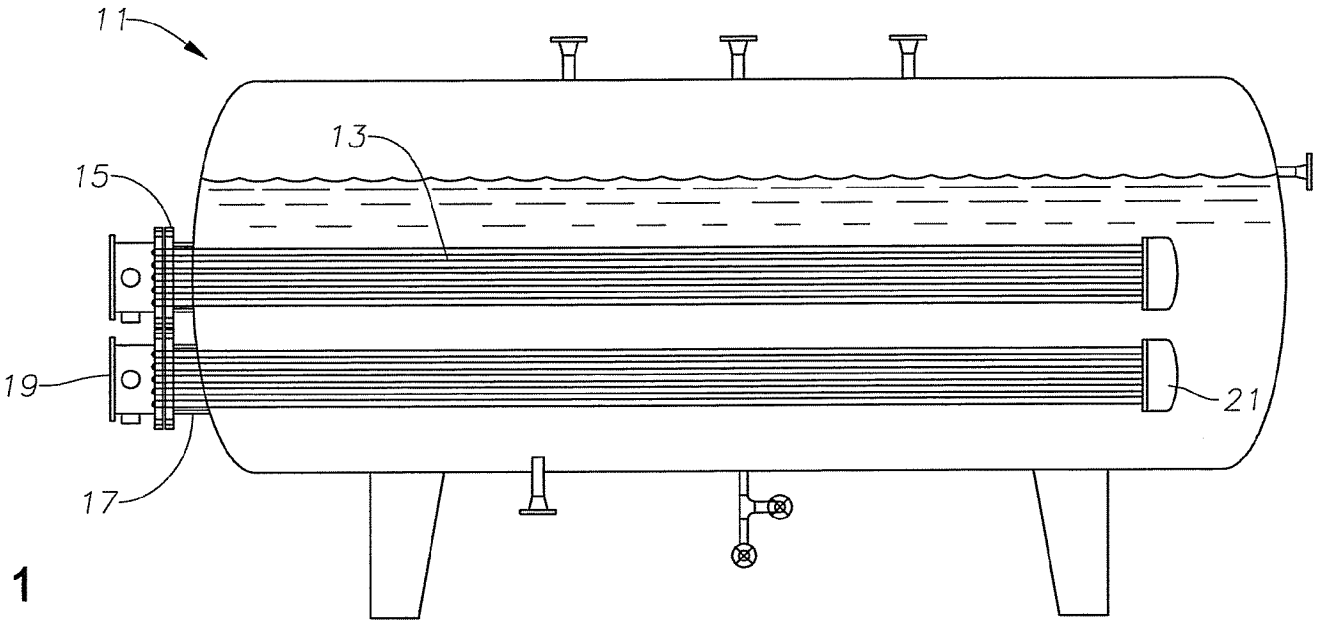
FIG. 1 is a schematic side elevational view illustrating a heat exchanger having heater elements constructed in accordance with this invention.

Referring to FIG. 1, a plurality of heater elements 13 extend into a tank 11 used for heat exchange purposes, typically in chemical and petroleum processing industries. Heater elements 13 preferably operate with three-phase AC power in the range from about 2,400 to 4,160 volts. Although considered a medium voltage for electrical power transmission in general, this voltage is higher than the voltages used typically with prior art process heat exchanger heater elements, typically about 600 to 640 volts. Heater elements 13 are shown in two separate bundles, but more or fewer bundles of heater elements 13 could be utilized. Heater elements 13 are tubular members that are immersed within water or other liquid for heating the liquid.

An exterior portion of each heater element 13 extends out of the front wall of tank 11 and through a header plate 15.

In this embodiment, two separate header plates 15 are shown, one for each bundle of heater elements 13. Each header plate 15 has an interior side in fluid communication with the interior of tank 11 via a tubular neck 17 welded to the front end of tank 11. The exterior ends of heater elements 13 extend through header plate 15 for connection to electrical power wires. A housing 19 bolts to header plate 15 and encloses the connector ends of heater elements 13.

In this example, each heater element 13 comprises a single straight rod. The interior end of each heater element 13 is electrically connected to at least one other heater element 13, and the interior ends are enclosed by a sealed end cover 21. Alternatively, each heater element 13 could be bent into a U-shape, with both ends located on the exterior of tank 11.

Figure 2:
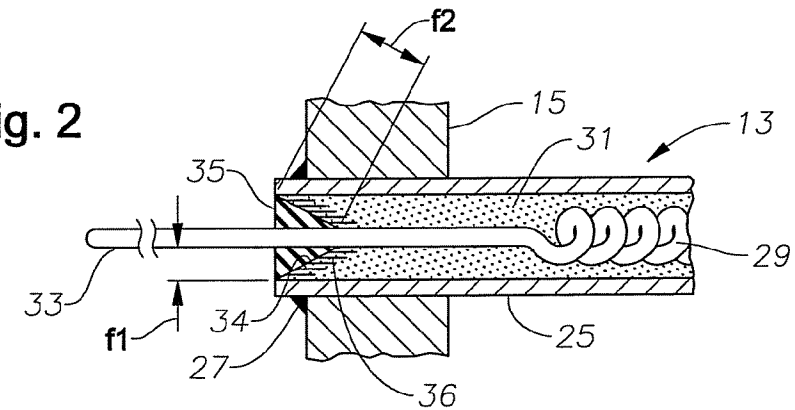
FIG. 2 is an enlarged sectional view of a portion of one of the heater elements of FIG. 1.
Figure 5:
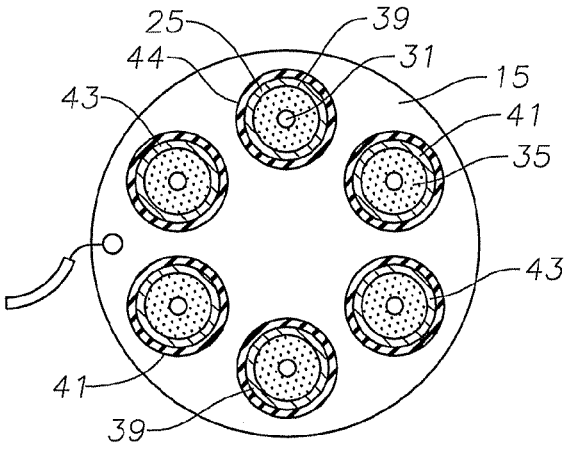
FIG. 5 is a sectional view of the heater elements of FIG. 4, taken along the line 5-5 of FIG. 4.
Figure 6:
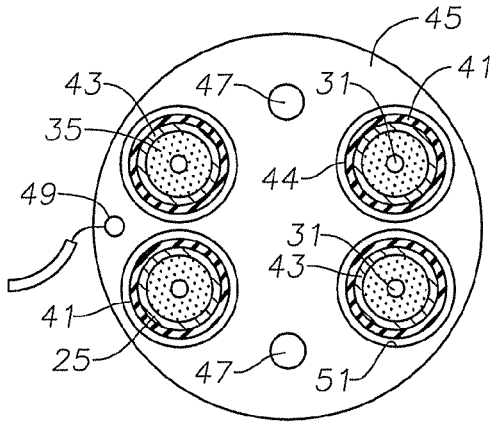
FIG. 6 is a sectional view of the heater elements of FIG. 4, taken along the line 6-6 of FIG. 4.
Figure 7:
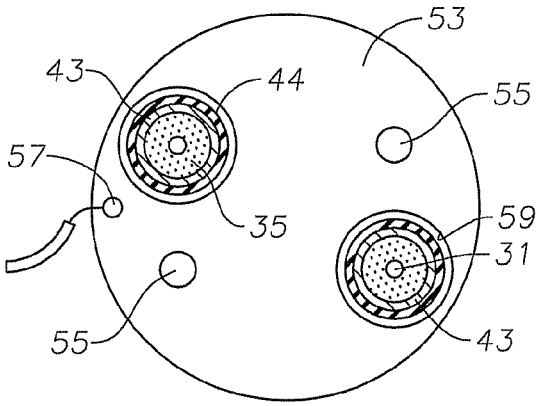
FIG. 7 is a sectional view of the heater elements of FIG. 1, taken along the line 7-7 of FIG. 4.
Figure 8:
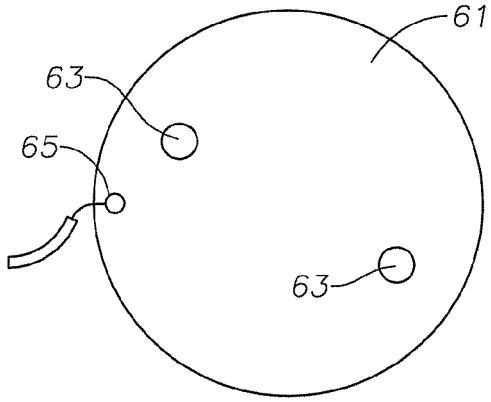
FIG. 8 is a top view of the heater element assembly as illustrated in FIG. 4.

Referring to FIG. 2, each heater element 13 includes a metal tube 25. Tube 25 extends through a hole in header plate 15 and is welded at weld 27 to the non-pressure side of header plate 15. Each heater element 13 also includes a coil wire 29 that extends the length of each tube 25. Coil wire 29 has a high electrical resistance for generating heat when electrical current passes through it. A typical material for wire 29 is a nickel-chromium alloy. Coil wire 29 is insulated from tube 25 by an insulation powder 31. Insulation powder 31 is preferably magnesium oxide, and it is packed tightly within tube 25 surrounding coil wire 29. A connector pin 33, which may be threaded, is secured to the exposed end of coil wire 29, such as by brazing.

During manufacturing, preferably heater elements 13 are heated in a dry atmosphere for a time and temperature sufficient to remove as much moisture as practical from insulation powder 31, which is a desiccant. This step may be performed in an oven. Either before or after the drying process, the exposed end face of insulation powder 31 of each heater element 13 is removed to form a generally conical-shaped cavity 34. Cavity 34 has a maximum diameter at the inner diameter of 25 and an apex at conductor pin 33. The maximum diameter is preferably close to or at the end of tube 25. Cavity 34 is preferably concentric with conductor pin 33.

Preferably a dielectric liquid (not shown) is poured into cavity 34 to create an infiltrated layer 36 (FIG. 3) within insulation powder 31. A preferred dielectric liquid is uncured silicone of a type that does not cure when exposed to air. Subsequently, air pressure is applied to the liquid silicone for a selected time interval, causing some of the dielectric liquid to infiltrate and seal the spaces between the grains of insulation powder 31. The viscosity of the dielectric liquid used to form infiltrated layer 36 may vary widely, such as from 25 centipoise to 25000 centipoise. The air pressure and duration of the process may vary also and typically is about 100 psi for five to ten minutes. No heat is required, and the dielectric liquid in infiltrated layer 36 remains uncured. The application of pneumatic pressure to the dielectric liquid causes some of the liquid to infiltrate or migrate into insulation powder 31, filling and sealing the spaces between the individual grains of insulation powder 31. The amount of dielectric liquid that actually enters the conical end face of insulation powder 31 is small, typically only migrating about 0.5 to 2.0 inches inward into insulation powder 31. Often, the extent of migration is about 0.75 inch, thus the depth of infiltrated layer 36 is normally only about 0.75 inch. After the dielectric liquid has migrated the typical distance, it tends to plug up insulation powder 31 and not migrate any further, regardless of the amount of time air pressure is applied. The dielectric liquid may reach its full penetration depth in less than five minutes. The dielectric liquid does not cure after entering insulation 31, rather remains a liquid.

After a sufficient time under pressure is reached, the air pressure is removed and the excess dielectric liquid removed from cavity 34. It is not necessary to thoroughly clean the dielectric liquid from cavity 34.

Then, a high voltage epoxy plug 35 is bonded in cavity 34. The material for epoxy plug 35 is commercially available and has a high electrical resistance. Referring to FIG. 3, epoxy plug 35 may be installed by first placing a sleeve 37 sealingly around the outer diameter of tube 25. Then, the technician pours liquid epoxy into sleeve 37 and into conical cavity 34. Heat may be employed for curing the epoxy, or the curing may take place at room temperature. After curing, the operator removes sleeve 37 and removes the excess epoxy, leaving only epoxy plug 35.

In the prior art type of heater elements (not shown), the insulation powder is flush with the end of the metal tube, thus is in a plane perpendicular to the axis of the tube. A breakdown in insulation resistance in the prior art more likely occurs at the flat end face of the insulation powder. The flat end face in the prior art heater element has a radial width equal to the radial distance f1 between the inner diameter of the metal tube and the conductor pin. In this invention, the end face of insulation powder 31 comprises the conical cavity 34. The distance along conical cavity 34 from conductor pin 33 to metal tube 25 is a straight line inclined relative to the axis of metal tube 25 at the angle of conical cavity 34 to the end of metal tube 25. This distance f2 is greater than the distance f1 that existed in the prior art. The longer gap results in insulation 31 being less likely to leak current under medium voltages.

In addition, preferably the exterior ends of heater elements 13 terminate at different distances from header plate 15, as illustrated in FIG. 4. Typically there will be a number of first phase heater elements 39 that are connected to a first phase of the AC power. Additionally, there will be a number of second phase heater elements 41 that are connected to each other and to the second phase of the AC power. Thirdly, there will be a group of third phase heater elements 43 connected to each other and to the third phase of the AC power. Only two of each of the heater elements 39, 41 and 43 are shown in FIGS. 5-8, but typically there would be many more of them.

To further reduce the chance of electrical arcing between the connector ends of heater elements 39, 41 and 43, insulator sleeves 44 are placed over the ends and protrude past epoxy plugs 35. In addition, preferably the ends of all of the first phase heater elements 39 are located at one distance from heater plate 15, the ends of second phase heater elements 41 at a second distance from the header plate 15, and the ends of third phase heater elements 43 at a third distance from the header plate 15. In the example shown, the ends of first phase heater elements 39 are closer to header plate 15 than the ends of second phase heater elements 41, and the ends of second phase heater elements 41 are closer to header plate 15 than the ends of third phase heater elements 43. However, this arrangement could be reversed or changed in any desired manner.

Rather than connecting individual wires to each connector pin 33, in this embodiment, a first phase conductor plate 45 is used to connect all of the conductor pins 33 of the first phase heater elements 39 to each other. Conductor plate 45 is an electrically conductive, thin flat disc that has small holes that are positioned to receive the protruding ends of pins 33. The ends of pins 33 are secured to conductor plate 45 by fasteners 47, which may be nuts that engage threaded sections on conductor pins 33. First phase conductor plate 45 has an electrical wire connector 49 that connects conductor plate 45 to the first phase of the AC power source. First phase conductor plate 45 also has a plurality of holes 51 through which second phase heater elements 41 and third phase heater elements 43 protrude. Holes 51 are slightly larger than the insulation sleeves 44 surrounding each second phase heater element 41 and each third phase heater element 43.

Similarly, a second phase conductor plate 53 is used to electrically connect conductor pins 33 of all of the second phase heater elements 41. Conductor plate 53 is a thin plate that is parallel to and spaced forward from first phase conductor plate 45. Second phase conductor plate 43 has holes arranged to receive fasteners 55 that secure second phase conductor plate 53 to conductor pins 33 of second phase heater elements 41. Second phase conductor plate 53 has an electrical connector 57 for connecting it to the second phase of the AC power. Holes 59 are placed in second phase conductor plate 53 to slide over each insulating sleeve 44 surrounding third phase heater elements 43.

A third phase conductor plate 61 mounts to pins 33 of all of the third phase heater elements 43. Third phase conductor plate 61 has holes arranged to receive conductor pins 33 and secure them to plate 61 with fasteners 63. Third phase conductor plate 61 has an electrical connector 65 that connects it to the third phase of the power source.

Referring again to FIG. 1, the ends of heater elements 13 that are located within the interior of tank 11 are preferably constructed in the same manner as the exterior ends. That is, the interior ends (not shown) may have epoxy plugs similar to epoxy plugs 35 (FIG. 2). Additionally, the interior ends for the different phases may protrude at different distances from the interior header plate (not shown) generally as described in connection with FIGS. 4-8. Conductor plates similar to conductor plates 45, 53 and 61 (FIG. 4) could be utilized for the interior ends, however there would be no direct connections to the power source, rather the conductor plates would be placing the interior ends of each phase in electrical common with each other.

The invention has significant advantages. The epoxy filled cavity in the end face provides excellent resistance for the heater element, particularly when the insulation powder also contains an infiltrated layer of silicone.

While the invention has been shown in only a few of its forms, it should be apparent to those skilled in the art that it is not so limited, but is susceptible to various changes without departing from the scope of the invention.

The invention claimed is:

1. An electrical heater bundle having a plurality of elements, each element comprising a metal tube, an electrical resistance coil within the tube, a conductor pin connected to the coil and protruding from an end of the tube, and an electrical insulation powder surrounding the coil within the tube, the improvement comprising:

a cavity in the insulation powder at the end of the tube concentric with the conductor pin;

an electrical insulation plug within and mating to the cavity, the insulation plug sealing around the conductor pin, sealing to the tube, and sealing the insulation powder from exposure to atmosphere at the end of the tube; and wherein the insulation powder has a layer of uncured dielectric liquid infiltrated therein at the cavity.

2. The heater element bundle according to claim 1, wherein the cavity and the plug are generally conical.

3. The heater element bundle according to claim 1, wherein the cavity is conical and has a maximum diameter equal to an inner diameter of the tube.

4. The heater element bundle according to claim 1, wherein the plug comprises an epoxy.

5. An electrical heater bundle having a plurality of elements, each element comprising a metal tube, an electrical resistance coil within the tube, a conductor pin connected to the coil and protruding from an end of the tube, and an electrical insulation powder surrounding the coil within the tube, the improvement comprising:

a cavity in the insulation powder at the end of the tube concentric with the conductor pin;

an electrical insulation plug within and mating to the cavity, the insulation plug sealing around the conductor pin, sealing to the tube, and sealing the insulation powder from exposure to atmosphere at the end of the tube;

a header plate to which the heater elements are mounted; wherein a first one of the heater elements protrudes past the header plate a first distance;

a second one of the heater elements protrudes past the header plate a second distance that is greater than the first distance; and a third one of heater elements protrudes past the header plate a third distance that is greater than the second distance.

6. The heater element bundle according to claim 5, wherein:

said first one of the heater elements comprises a first group of the heater elements;

said second one of the heater elements comprises a second group of the heater elements; and said third one of the heater elements comprises a third group of the heater elements; and wherein the bundle further comprises:

a first conductor plate connected to ends of the conductor pins of the first group and having holes through which the second and third group of heater elements protrude;

a second conductor plate connected to ends of the conductor pins of the second group and having holes through which the third group of heater elements protrude; and a third conductor plate connected to ends of the conductor pins of the third group, the second conductor plate being located between the first and third conductor plates.

7. The heater element bundle according to claim 6, further comprising:

an insulation sleeve encasing each tube of each of the second group of heater elements and extending from the header plate through one of the holes in the first conductor plate; and an insulation sleeve encasing each tube of each of the third group of heater elements and extending from the header plate through one of the holes in the second conductor plate.

8. An electrical heater bundle having a plurality of elements, each element comprising a metal tube, an electrical resistance coil within the tube, a conductor pin connected to the coil and protruding from an end of the tube, and an electrical insulation powder surrounding the coil within the tube, the improvement comprising:

a conical cavity in the insulation powder at the end of the tube, the cavity extending from an inner diameter of the tube to the conductor pin; wherein the cavity is filled with an epoxy; and wherein the insulation powder has a layer of uncured liquid silicone infiltrated therein at the cavity.

9. An electrical heater bundle having a plurality of elements, each element comprising a metal tube, an electrical resistance coil within the tube, a conductor pin connected to the coil and protruding from an end of the tube, and an electrical insulation powder surrounding the coil within the tube, the improvement comprising:

a conical cavity in the insulation powder at the end of the tube, the cavity extending from an inner diameter of the tube to the conductor pin; wherein the cavity is filled with an epoxy; and the heater element bundle further comprises:

a header plate to which the heater elements are mounted; wherein a first one of the heater elements protrudes past the header plate a first distance;

a second one of the heater elements protrudes past the header plate a second distance that is greater than the first distance; and a third one of heater elements protrudes past the header plate a third distance that is greater than the second distance.

10. The heater element bundle according to claim 9, wherein:

said first one of the heater elements comprises a first group of the heater elements;

said second one of the heater elements comprises a second group of the heater elements; and said third one of the heater elements comprises a third group of the heater elements; and wherein the heater element bundle further comprises:

a first conductor plate connected to ends of the conductor pins of the first group and having holes through which the second and third group of heater elements protrude;

a second conductor plate connected to ends of the conductor pins of the second group and having holes through which the third group of heater elements protrude; and a third conductor plate connected to ends of the conductor pins of the third group, the second conductor plate being located between the first and third conductor plates.

11. A method of making a heater element from a tube having an electrical resistance coil embedded within an insulation powder and a conductor pin protruding from an end of the tube, the insulation powder having an exposed face at an end of the tube, comprising:

(a) removing a portion of the insulation powder at the end of the tube to form a cavity at the exposed face of the insulation powder surrounding the conductor pin;

(b) pouring an epoxy into the cavity and curing the epoxy; and after step (a) and prior to step (b) filling the cavity with a dielectric liquid and applying pressure to the dielectric liquid to cause some of the dielectric liquid to infiltrate into the exposed face of the insulation powder, then removing the pressure and excess dielectric liquid.

12. The method according to claim 11, wherein step (a) comprises making the cavity conical.

13. The method according to claim 11, wherein the dielectric liquid comprises liquid silicone.

* * * * *